US005309165A

United States Patent [19]

Segal et al.

[11] Patent Number: 5,309,165

[45] Date of Patent: May 3, 1994

[54] POSITIONER WITH CORNER CONTACTS FOR CROSS NOTCH ARRAY AND IMPROVED RADIATOR ELEMENTS

[75] Inventors: Gary I. Segal, Randallstown, Md.; Samuel P. Nguyen, Arlington, Va.; Kenneth M. Leader, Glen Burnie, Md.; Thomas A. Ward, Kingsport, Tenn.

[73] Assignee: Westinghouse Electric Corp., Pittsburgh, Pa.

[21] Appl. No.: 880,406

[22] Filed: May 9, 1992

[51] Int. Cl.[5] ..... H01Q 13/10

[52] U.S. Cl. ..... 343/770; 343/767

[58] Field of Search ..... 343/767, 770, 771, 795, 343/797, 798, 789, 820, 821; H01Q 13/10

[56] References Cited

U.S. PATENT DOCUMENTS 4,001,834 1/1977 Smith ..... 343/754
5,023,623 6/1991 Kreinheder et al. ..... 343/770
5,175,560 12/1992 Lucas et al. ..... 343/770
5,202,698 4/1993 Jelloul ..... 343/770

*Primary Examiner*—Donald Hajec
*Assistant Examiner*—Hoanganh Le
*Attorney, Agent, or Firm*—Eugene LeDonne

[57] ABSTRACT

A dual polarized cross notch array employing a positioner for locating and grounding metallized portions of unrestrained element ends with respect to metallized restrained element ends. The positioner is a planar member having spaced rows and slots in intersecting rows and columns. Conductive tabs are formed adjacent to the slots at the intersections of the rows and columns corresponding to intersections of the element ends. The conductive tabs receive corresponding portions of the intersecting element ends in secure mechanical engagement and electrical contact. The positioner maintains the polarized elements rigidly in orthogonal configuration. In alternative embodiment employs conductive members preferably formed of tape at the inside corners of the array. Improved radiator elements and a positioner for preconfiguring the array is also disclosed.

14 Claims, 10 Drawing Sheets

WITHOUT POSITIONER
4 GHZ

WITH POSITIONER
4 GHZ

WITHOUT POSITIONER
12 GHZ

WITH POSITIONER
12 GHZ

POSITIONER WITH CORNER CONTACTS FOR CROSS NOTCH ARRAY AND IMPROVED RADIATOR ELEMENTS

BACKGROUND OF THE INVENTION

1. Field of the Invention

The invention relates to dual polarized cross notch arrays and in particular the invention is concerned with antenna elements and a positioner and electrical contacts for locating and grounding metallized portions of unrestrained element ends with respect to the restrained element ends.

2. Description of the Prior Art

Dual polarized cross notch arrays are known. FIG. 1 shows one such array 10 which is fabricated by forming a plurality of sets of orthogonal antenna elements 12 and 16 respectively disposed on substrates 14 and 18. The first set of elements 12, such as shown in FIG. 2, is etched from a metallized layer 13 on each one of a first set of substrates 14. A similar set of elements 16, shown in FIG. 3, is formed from an etched metallized layer 15 on each one of a second set of substrates 18. Respective front and rear slots 17 and 19 extending from corresponding front and rear marginal edges 21 and 22 are formed in substrates 14 and 18 intermediate to the elements 12 and 16 in evenly spaced parallel rows. The front marginal edges 21 are unrestrained as hereinafter described. When the respective front and rear slots 17 and 19 are mated, the set of substrates 14 and 18 are arranged into orthogonal array 10 of elements having intersections 27 resulting in a so called egg crate configuration (FIG. 4). The substrates 14 and 18 of the array 10 intersect resulting in four inside corners 32 and open spaces 23. The radiator elements 12 and 16 are between the intersections and face outwardly from a planar front end 24 of the structure. The front slots 17 in the first set of substrates 14 result in separate unrestrained free ends 25 of the elements 12 at the front marginal edge 21 of the substrate 14. The elements 16 in the rear slotted substrate 18 have restrained free ends 26 at the front edge 20. The free ends 25 of the unrestrained elements 12 can thus become misaligned when the substrates 14 and 18 are assembled which can adversely upset the symmetry of the array 10. Also, continuity of the metallized layer 13 forming the ground plane between the elements 12 is broken by the front slots 17 which can cause radiation of unwanted modes.

FIG. 4 shows an ideal rectangularly aligned and symmetrical array 28 of restrained and unrestrained elements 12 and 16 looking in from the radiating side. The row spacing $S_r$ and column spacing $S_c$ are all the same. The first substrates 14 are orthogonal with respect to the second substrates 18 so that the angle $A=90°$.

FIG. 5 is a somewhat exaggera shows what may happen to the array 28' when the substrates 14 and 18 are not precisely orthogonal that is when the angle A does not equal 90° and when the column spacing $S_c$ is not uniform. Free ends 25 of the unrestrained elements 12 are not uniformly spaced at the planar front end 24 and the array 28' is not symmetrical.

Some attempts have been made to accurately locate and ground the unrestrained elements 12 with the respect to the restrained elements 16. However, such attempts have not been entirely satisfactory because of the great deal of manual work required to align and secure the elements in a periodic array.

In addition to the physical constrains, individual radiator elements 12 and 16 have mechanical and electrical characteristics which require improvement. In particular, the radiators 12 and 16 employ stripline feeds 29 buried within the substrates 14 and 18 which require an impedance match without being too small to economically and reliably manufacture. Bandwidth improvements at the low end, for example 2 GLHz are also desired. Further enhancements in order to reduce VSWR and increase gain are also desired.

SUMMARY OF THE INVENTION

In accordance with the invention a positioner for locating and grounding metallized portions of unrestrained element ends with respect to metallized restrained element ends in a dual polarized cross notch array is described which obviates the disadvantages and shortcomings of the described prior arrangement. In particular, the positioner comprises a planar member having spaced rows of slots in intersecting rows and columns corresponding to the respective restrained and unrestrained element ends of the array. Conductive tab means is formed in the slots at the intersections of the rows and columns corresponding to intersections of the restrained and unrestrained element ends. The conductive tab means receives and secures corresponding portions of the intersecting element ends in secure mechanical engagement and electrical contact. The positioner maintains the polarized elements rigidly in a uniform orthogonal configuration.

In one embodiment of the invention the slots have a lower wall portions within the planar member and upstanding wall portions extending therefrom towards a free surface thereof. Chamfered wall portions extend from the free surface of the planar member to the upstanding wall portions for facilitating reception and alignment of the element ends therein. In another embodiment of the invention apertures are formed in the planar member between tab means for exposing the elements to free space.

In a preferred embodiment the slots are machined into the planar member to a selected depth. Leading edge chamfers are formed by removing portions of the upstanding wall of the slot near the open end of the slot. The slots and the face of the planar member are plated with a conductive material, for example copper. The sides and opposite face of the planar member are masked against such plating. The plated face of the planar member is thereafter machined to remove selected portions of the copper plating between the tab members. Apertures are formed in the planar member between the intersections to provide windows for the element ends. The array results in an output which is improved over unrestrained arrays. The positioner is secured to the front end of the cross notch array so that the restrained and unrestrained elements are respectively located in corresponding rows and columns of the positioner between the conductive tab means and with ground connections between the unrestrained elements being achieved by means of the conductive tab means.

In another embodiment of the invention tape elements are installed at the intersections of the unrestrained and restrained elements in each of the four corners.

In each of the foregoing embodiments, a positioning fixture is described which realigns the restrains and the unrestrained elements and squares the cross notch array prior to mating with the positioner or installation of the conductive tape elements.

In another embodiment of the invention improved radiator elements have a modified stripline feed and transition, each employing quarter wavelength squares. The elements have a taper exhibiting low VSWR and high gain over a 16 GHz bandwidth.

DESCRIPTION OF THE PREFERRED EMBODIMENT

Figure 6:
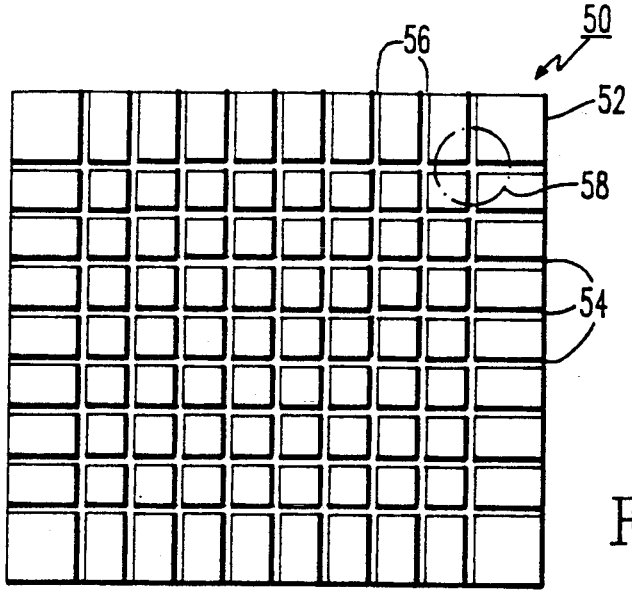
FIG. 6 is an illustration of a positioner preform according to the invention.
Figure 7:
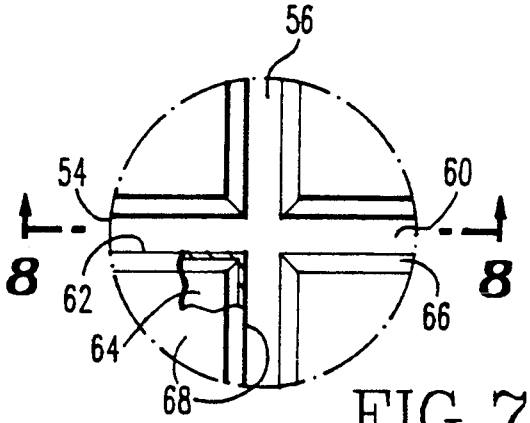
FIG. 7 is an enlarged detail of an intersection of rows and columns illustrated in FIG. 6.
Figure 8:
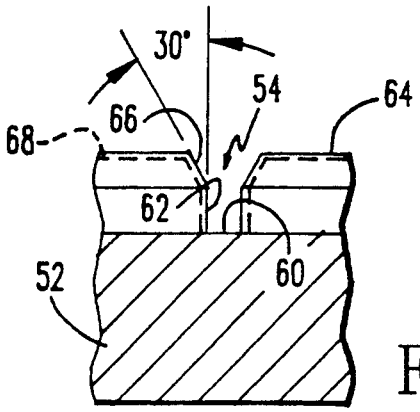
FIG. 8 is a side sectional view taken along lines 8—8 of FIG. 7.

FIGS. 6–8 illustrate a positioner preform 50 in accordance with the present invention. The preform 50 comprises a dielectric substrate 52 such as polystyrene which is initially formed with respective rows and columns 54 and 56 of the slots which cross at intersections 58. The slots 54 and 56 have a lower wall portion 60 and upstanding wall portion 62 extending toward the upper surface 64 of the substrate 52. Chamfered surfaces 66 are formed in the upstanding wall 62 and meet the free surface 64 as illustrated in FIGS. 7 and 8. The slotted and chamfered preform 50 is appropriately masked and thereafter electroplated with a layer 68 of conductive material such as copper which covers the bottom wall 60 the upstanding side wall 62, the chamfer 66 and the upper surface 64.

Figure 9:
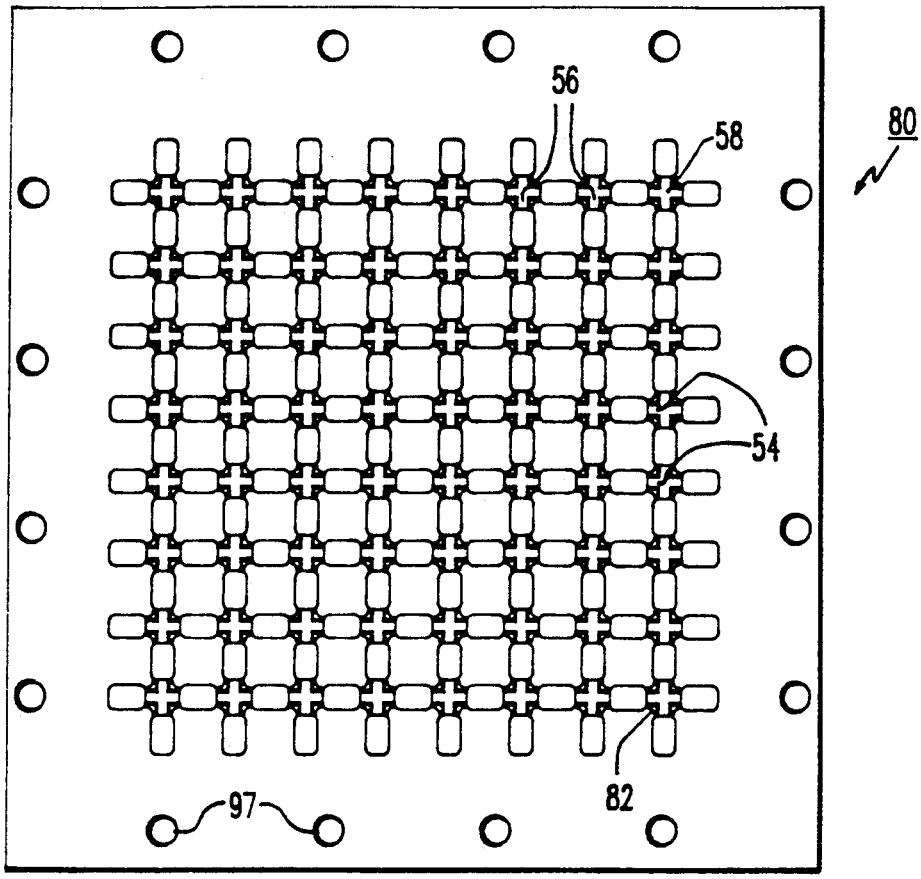
FIG. 9 is an illustration of a concluded positioner in accordance with the present invention.
Figure 10:
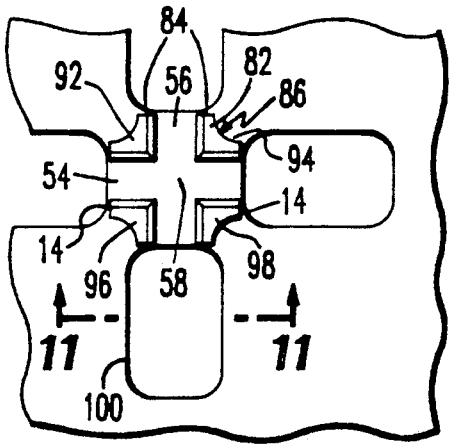
FIG. 10 is an enlarged detail of an intersection of rows and columns illustrating opposed tab members.
Figure 11:
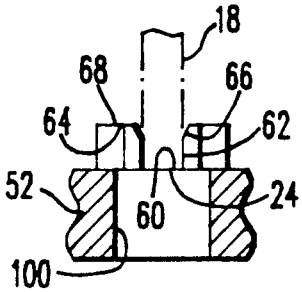
FIG. 11 is a side sectional view taken along lines 11—11 of FIG. 10.

The preform 50 is further processed as illustrated in FIGS. 9–11 to result in a positioner 80 according to the invention. Portions of the substrate 52 intermediate to each of the intersections 58 are removed by a machining process resulting in sets of conductive tabs 82, each one of which include the lower wall 60, the upstanding wall 62, the chamfered portion 66 and the upper surface 64 previously described. The resulting tabs 82 also include marginal upstanding walls 84 and interconnecting upstanding curved rear walls 86. The tabs 82 are located in sets of four corner portions 92, 94, 96 and 98 symmetrically about each intersection 58. Holes 97 are formed as indicated for receiving fasteners (not shown).

The corner portions 92–98 are described with respect to their relative position in the drawing as follows. The upper corner portions 92 and 94 oppose lower corner portions 96 and 98 along the rows 54. The left hand corner portions 92 and 96 oppose the right hand corner portions 94 and 98 along the columns 56. The positioner 80 engages the egg crate structure 10 so that each set of corner portions 92, 94, 96 and 98 receives an intersecting portion 27 between the elements 12 and 16. In particular, a portion of the free ends 26 of the restrained elements 16 engage the rows 54 between the upper and lower corner portions 92 and 94 while a portion of the free ends 25 of the unrestrained elements 12 engage columns 56 between the left and right corner portions 92 and 98. The chamfered surfaces 66 allow the substrates 14 and 18 to ease into the respective slots 54 and 56. The corresponding substrate portions 14 and 18 fit snugly between the upstanding walls 62 of the sets of the tabs so that the front end of the array 10 lies against the bottom walls 60. The dimensions are such that the substrates are snugly held by the corner portions 92–98. The respective substrates 14 and 18 are restrained from lateral movement when the respective free ends 25 and 26 are located between the tabs 82. Thus, the restrained elements 16 and the unrestrained elements 12 are held orthogonally and in a uniform symmetrical array by the positioner 80.

In a preferred embodiment of the invention, apertures or windows 100 are formed between the sets of corner portions 92–98 and about the periphery of the sets of corner portions 92–98 as illustrated. The windows 100 expose the radiator elements 12 and 16 which are located between the intersections 27 of the substrates 14 and 18.

Figure 12C:
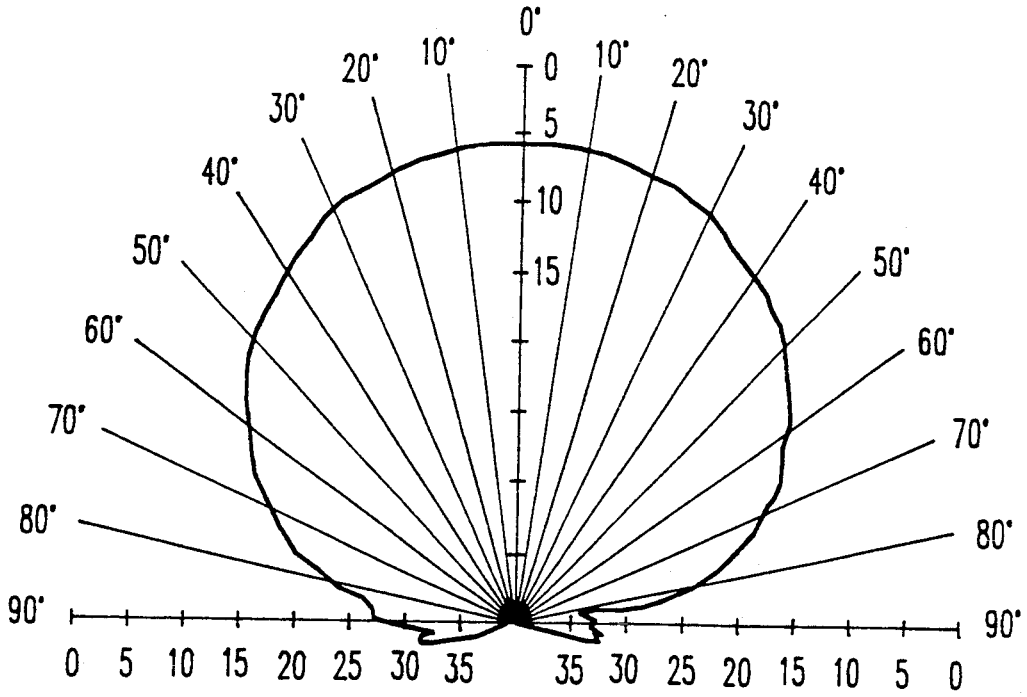
FIGS. 12A–12D illustrate array patterns with and without the positioner of the present invention at various frequencies.
Figure 12A:
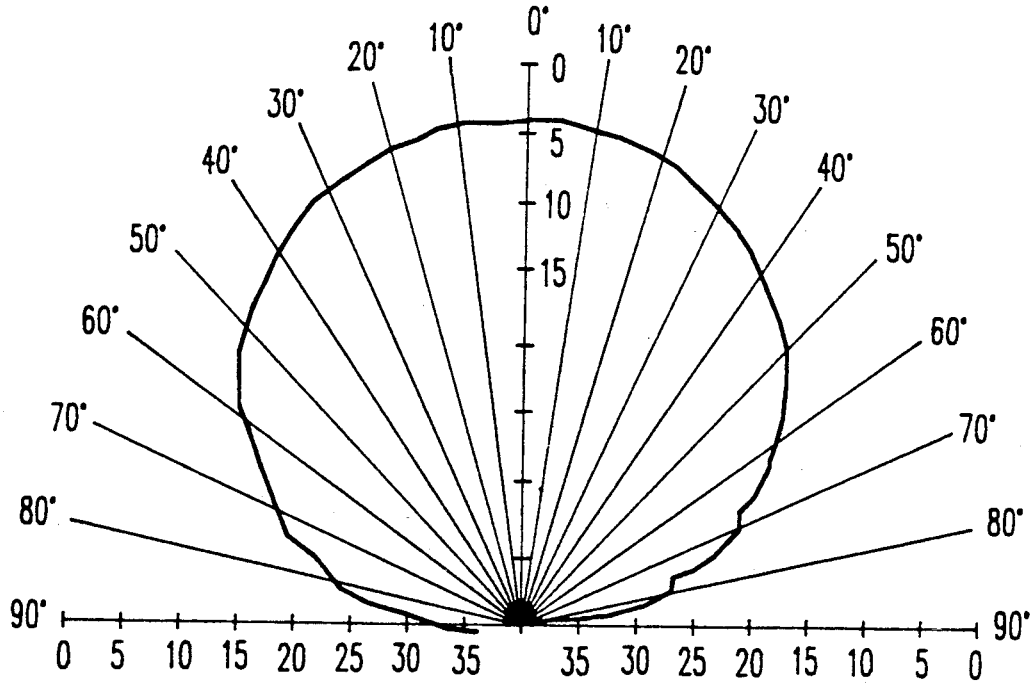
Figure 12D:
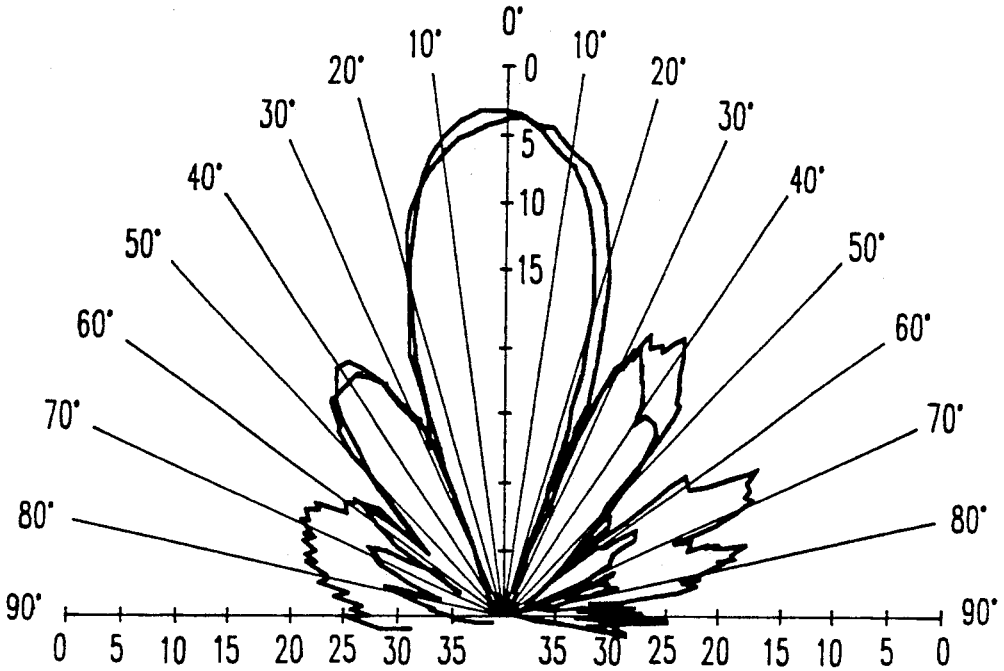
Figure 12B:
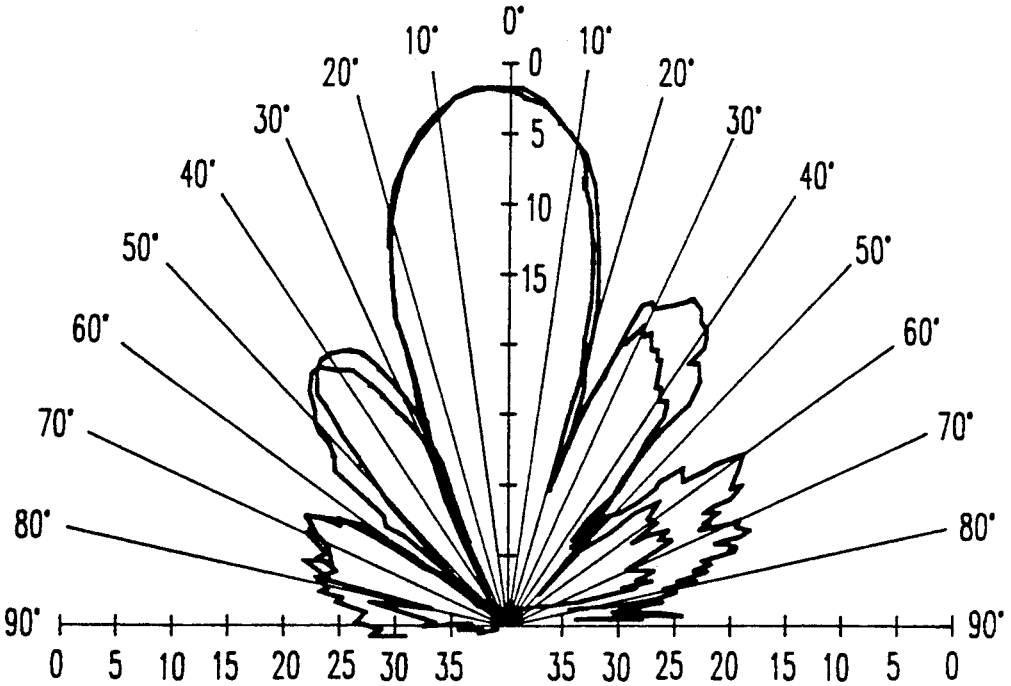

FIGS. 12A–12B illustrate radiation patterns at 4 GHz and 12 GHz, respectively, produced by the cross notch array 10 in accordance with the present invention with the positioner 80 in place as illustrated in FIG. 11.

FIGS. 12C–12D illustrate the response of the cross notch array without the positioner at 4 GHz and 12 GHz, respectively. It can be seen that the positioner improves gain significantly. See for example the Table below which shows gain measurements versus frequency with and without the positioner.

| Frequency (GHz) | Gain (dBi) without positioner | Gain (dBi) with positioner |
|---|---|---|
| 4 | 4.5 | 6 |
| 8 | 10.5 | 12.5 |
| 12 | 11.5 | 13.0 |
| 16 | 13.5 | 14.0 |

The data and the array patterns suggest that the positioner 80 has no significant effect on the sidelobe levels and the scan volume of the array. Additional gain is achieved when the windows 100 are employed. In an arrangement of the invention without the windows 100, losses resulting from the presence of dielectric material in front of the radiator elements 12 and 16 is about 1 db or less.

Figure 1:
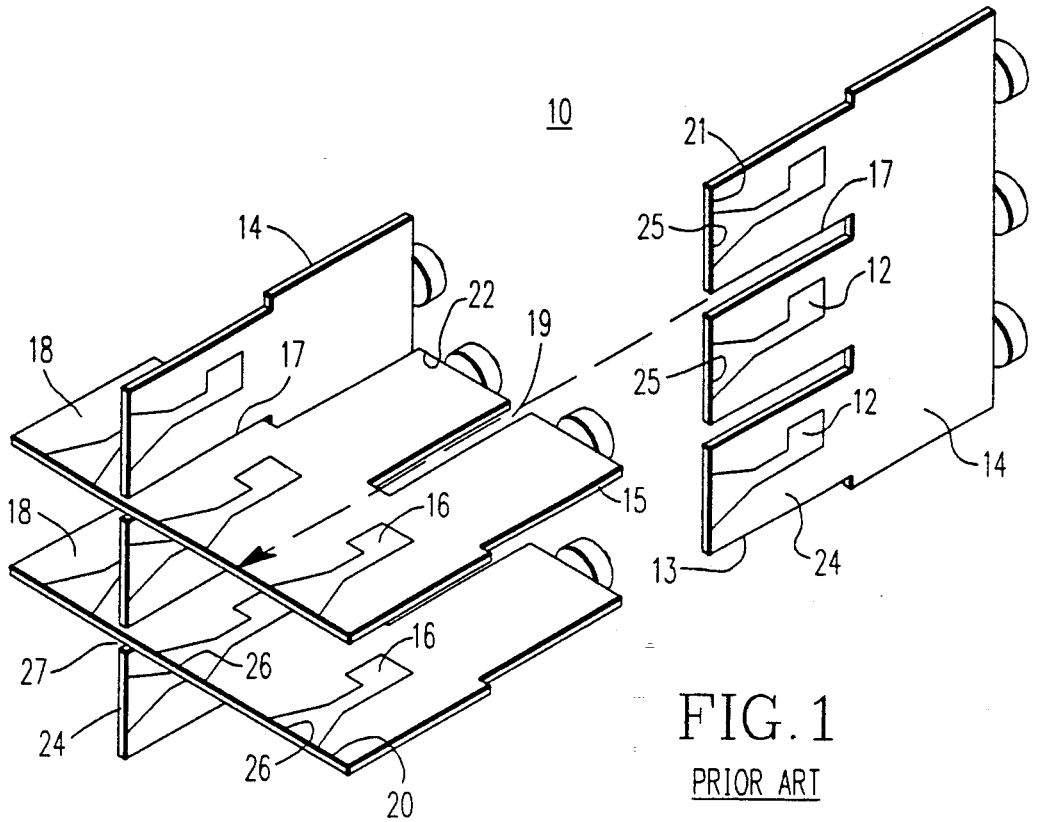
FIG. 1 PRIOR ART
FIG. 1 is a perspective view of a known cross notched array.
Figure 2:
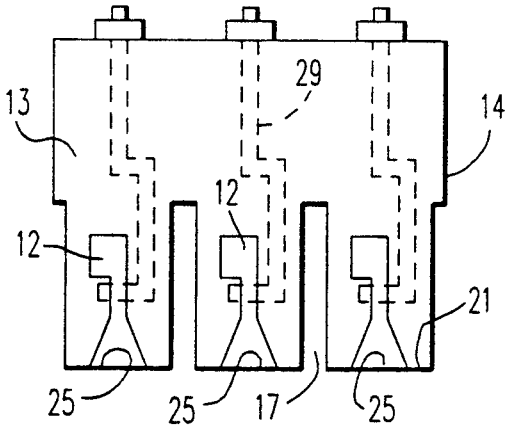
FIG. 2 PRIOR ART
FIGS. 2 and 3 are plan views of the substrates for the cross-notched array.
Figure 3:
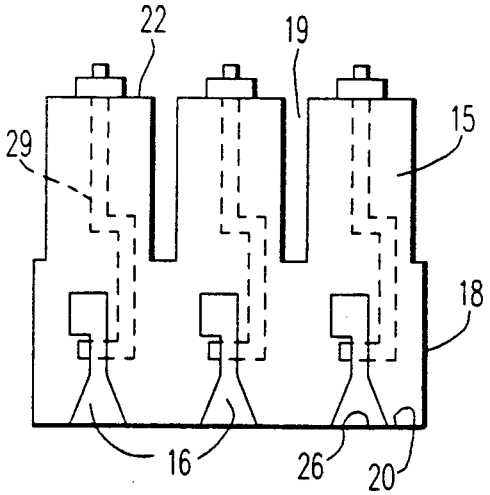
FIG. 3 PRIOR ART
Figure 4:
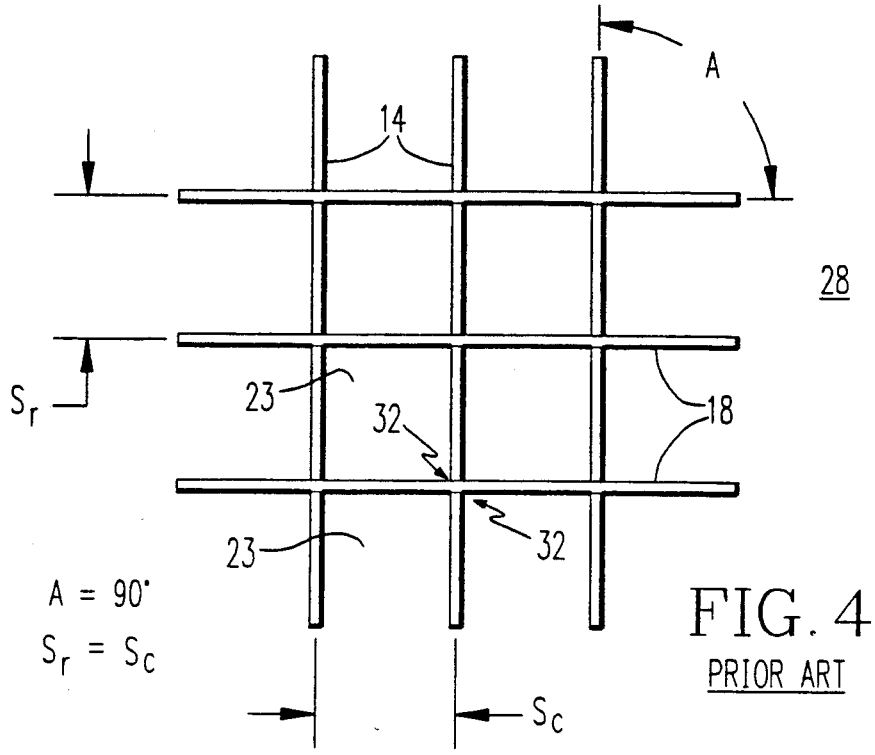
FIG. 4 PRIOR ART
FIG. 4 illustrates the desired geometry for the array.
Figure 5:
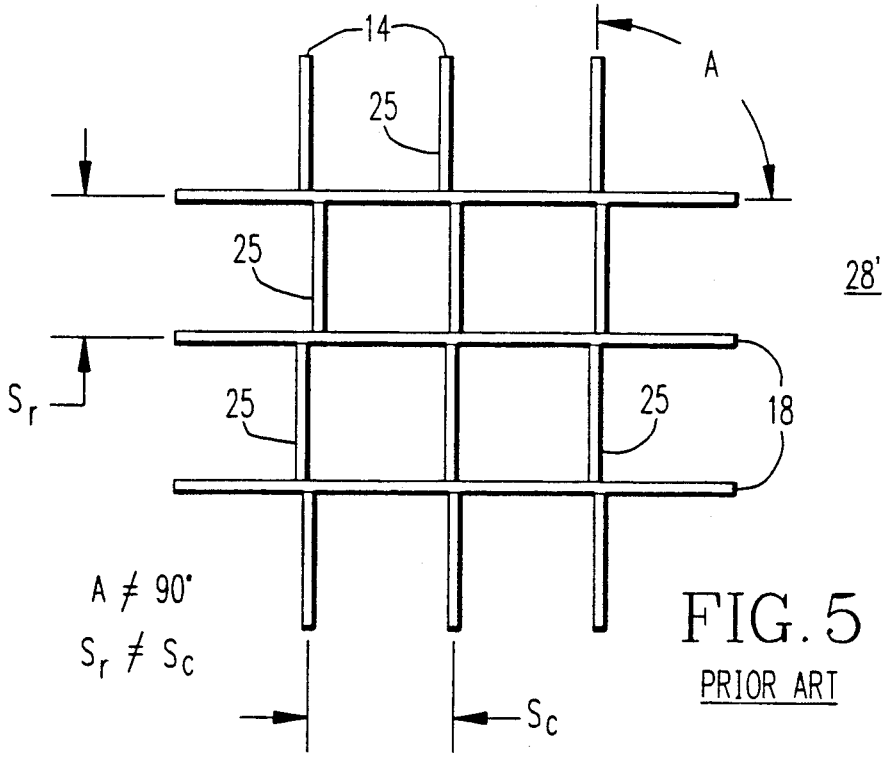
FIG. 5 PRIOR ART
FIG. 5 illustrates a misaligned array in an unrestrained embodiment.
Figure 13:
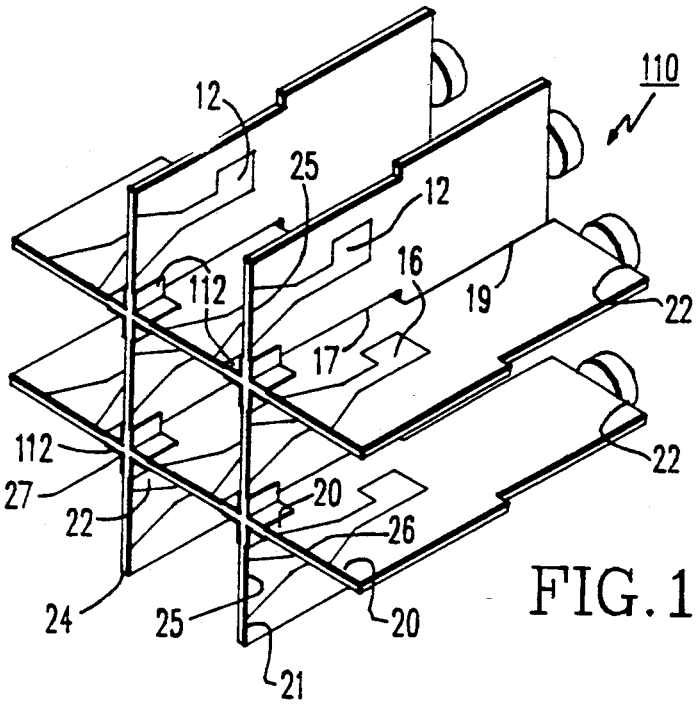
FIG. 13 is an illustration of another embodiment of the invention employing soldered or taped corner inserts.

In an alternative embodiment of the invention illustrated in FIG. 13, an array 110 is illustrated. The array 110 has elements which is similar to the elements bearing the same reference numerals in FIG. 1. Metal tabs 112, each in the form of conductive tape, are preferably located on each of the four inside corners 22 of each of the intersections 27 to secure the restrained and unrestrained elements 16 and 12 together in a mechanically aligned and electrically continuous configuration. The tabs 112 complete the ground plane of the radiator elements 12 and 16 and structurally position the free ends 26 of the restrained elements 16 with respect to the free ends 25 of the unrestrained elements 12. Alternatively, a solder bead (not shown) may be substituted for the tabs 112. The solder in the opposing corners 22 may be advantageously applied with a four pronged soldering iron (not shown).

Figure 14:
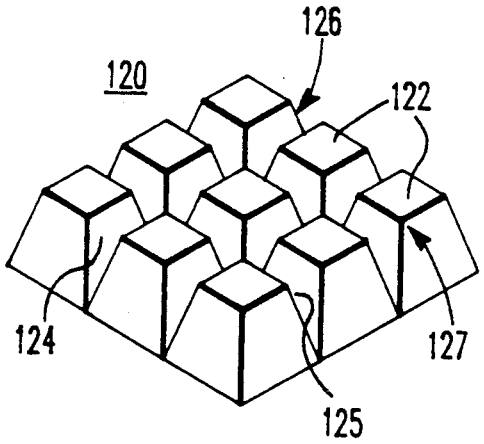
FIG. 14 illustrates a positioning fixture for use in prealigning and squaring the cross notch array prior to final assembly.

In the arrangement of the present invention and in order to align the respective restrained and unrestrained elements 16 and 12, a fixture 120 shown in FIG. 14 may be employed in which tapered pins 122 or the like are centered in the openings 23 of the structure 110. The tapered pins 122 are in an array which corresponds to the desired configuration of the structures 10 and 110, that is, with tapered walls 124 and 125 forming rows and columns 126 and 127 which receive the front end 24 of the structure 10 therein to thereby align the unrestrained elements 25 and to square the structure. Thereafter, in accordance with one embodiment of the invention, the positioner 80 may be located over the front end 24 of the egg crate structure 10. Alternatively, the aligned structure may be secured by means of the conductive tabs 112 or solder. In either case, the aligning fixture 120 may be employed to simplify the assembly procedure.

Figure 16:
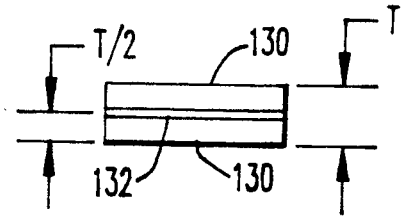
FIG. 16 is an end view of the radiator element illustrated in FIG. 15.
Figure 15:
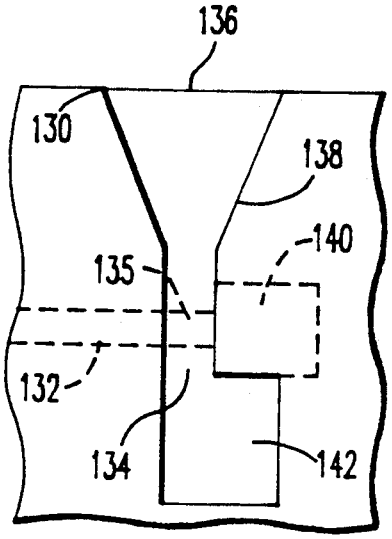
FIG. 15 illustrates a fragmentary top plan view of an improved radiator element according to the invention.

In accordance with another embodiment of the invention illustrated in FIGS. 15 and 16, radiator elements 130 and input striplines 132 are formed with enhancements designed to improve impedance match to increase bandwidth and gain and to reduce VSWR. The improved radiator element 130 includes an input end 134 coupled to stripline element 132 as illustrated. An output end 136 is coupled to the input 134 by a pair of curved tapers 138 in a dual slotline configuration. The output radiates to free space. The input end 134 of the slotline element 130 and stripline element 132 are coupled at transitions 135 and each have respective rectangular mating terminations 140 and 142.

The rectangular terminations 140 and 142 replace conventional $\frac{1}{4}$ wavelength transitions and improve bandwidth. In a particular embodiment, the terminations 140 and 142 are square and increase the bandwidth of the radiator 130 from 6–18 GHz to 2.0–18 GHz.

Figure 17A:
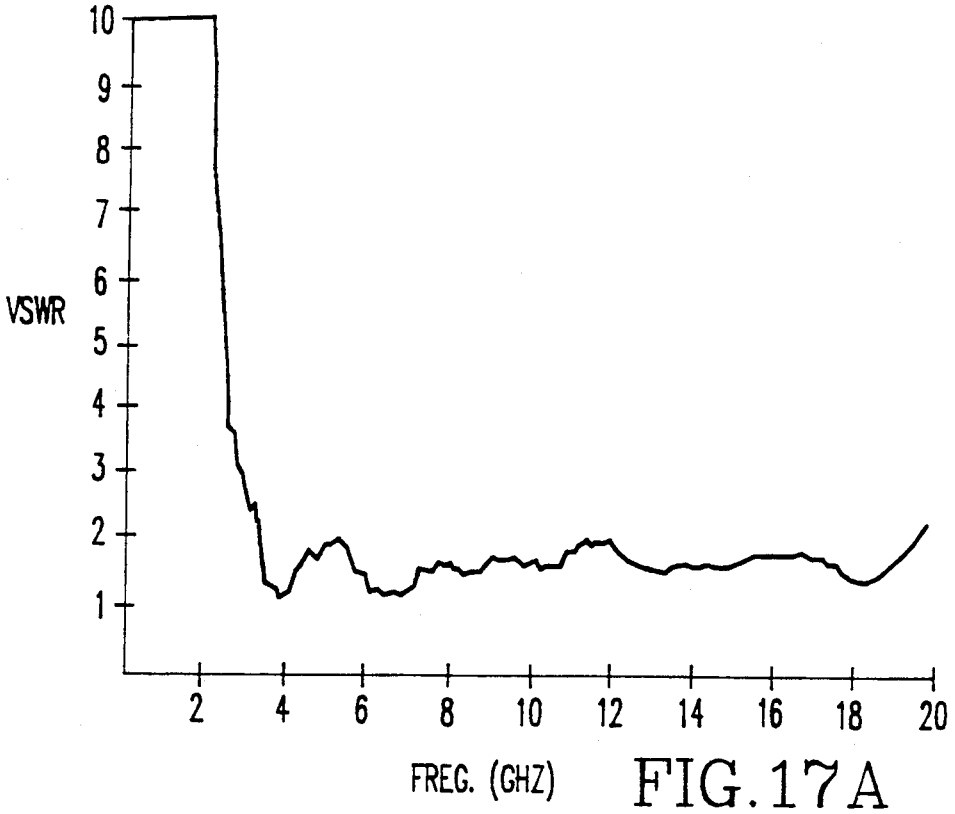
FIGS. 17A–17E illustrate graphically VSWR, gain and array patterns for $3\times1$ array of elements illustrated in FIGS. 15 and 16.
Figure 17B:
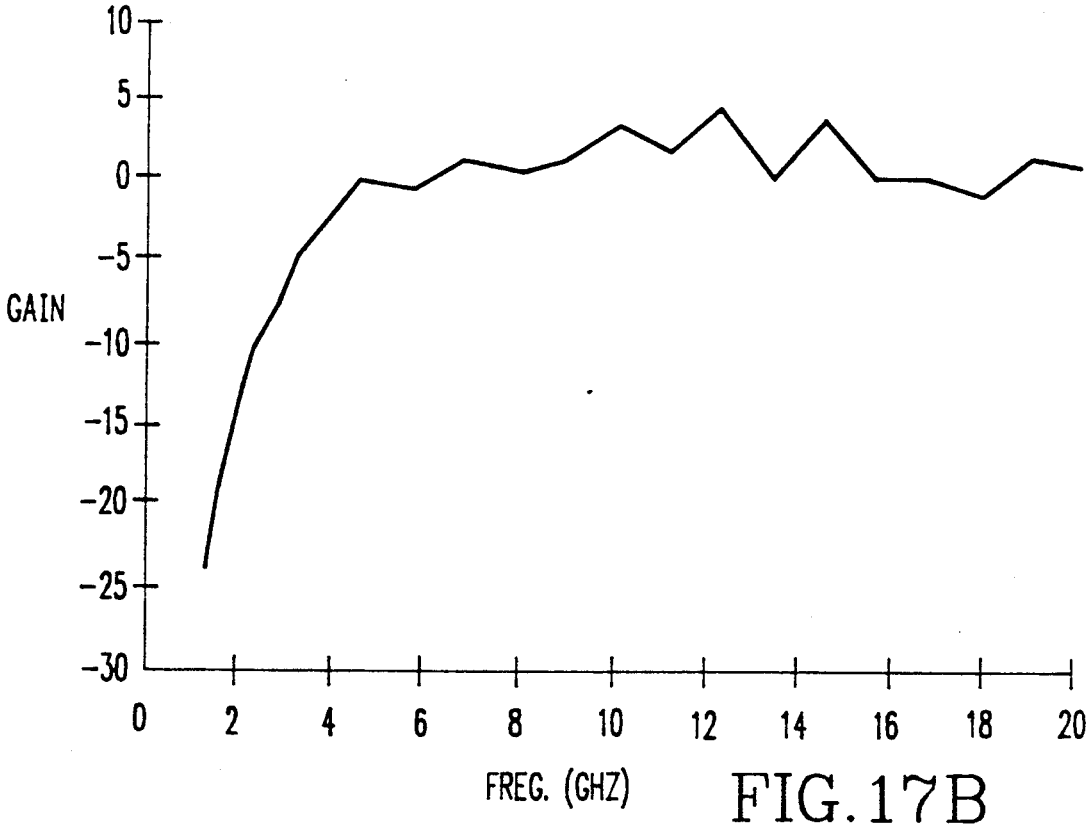
Figure 17C:
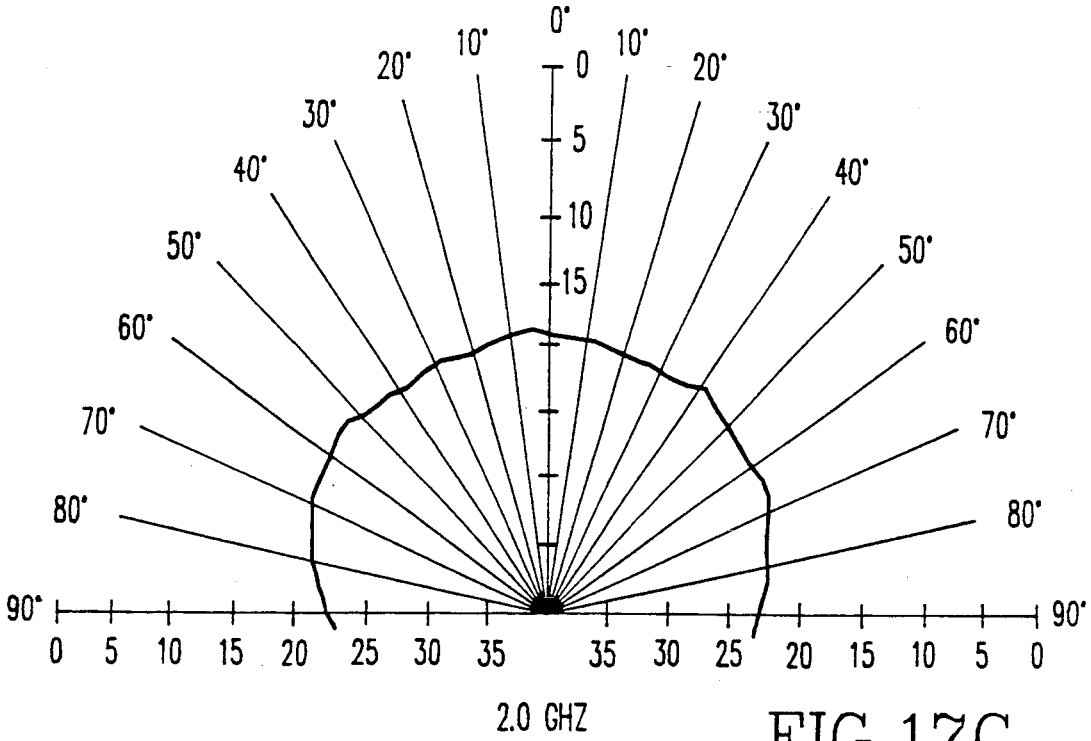
Figure 17D:
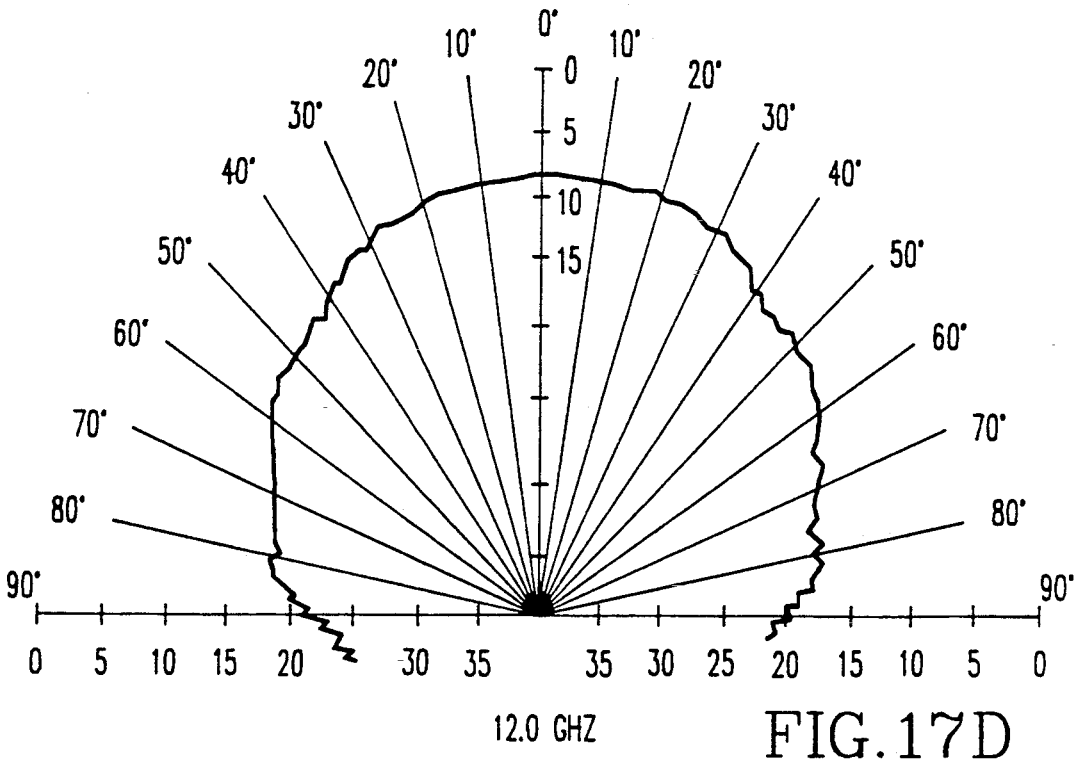
Figure 17E:
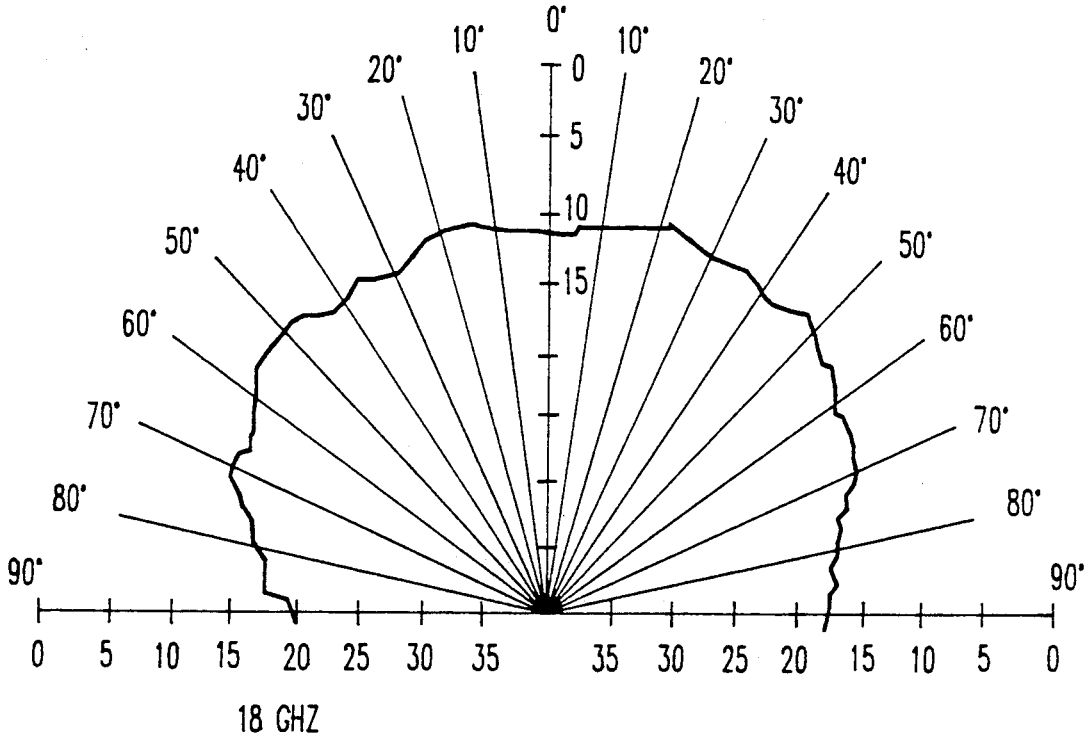

The taper profile transforms the wave to free space while reducing VSWR and increasing gain. The VSWR response of an exemplary $3\times1$ array of elements 130 is shown in FIG. 17A. The gain is plotted in FIG. 17B. Array patterns are illustrated in FIGS. 17C, 17D and 17E for 2.0 GHz, 12.0 GHz and 18.0 GHz respectively.

While there have been described what at present are considered to be the preferred embodiments of the present invention it will be apparent to those skilled in the art that various changes and modifications may be made therein without the departing from the invention and it is intended in the appended claims to cover all such changes and modifications as forward in the true spirit and scope of the invention.

What is claimed is:

1. A positioner for locating and grounding metallized portions of unrestrained element ends with respect to metallized restrained element ends in a dual polarized cross notch array comprising:

a planar member having spaced slots in respective parallel rows and parallel columns said rows and columns intersecting at right angles, said rows and columns of slots corresponding to the respective restrained and unrestrained element ends; and conductive tab means formed adjacent the slots at the intersections of the rows and columns corresponding to intersections of the restrained and unrestrained element ends for receiving and securing the metallized portions of the intersecting element ends therein.

2. The positioner of claim 1 wherein the planar member has apertures formed therein each aperture located at the intersection of each row and each column.

3. The positioner of claim 1 wherein planar member includes a planar surface and the slots each have a lower wall portion within the planar member, upstanding side wall portions extending from the lower wall portion and chamfered wall portions extending from the planar surface of the planar member towards the upstanding side wall portions for receiving and aligning the element ends therein.

4. The positioner of claim 1 wherein the positioner is a dielectric.

5. The positioner of claim 1 wherein the conductive tabs are formed from a machined copper film.

6. A dual polarized cross notch array comprising:

a plurality of substrates in respective first and second sets, each substrate having a metallized film thereon and having front and rear marginal edges, a plurality of adjacent radiator elements formed in the metallized film and on each substrate, each radiator element having an output end adjacent the front marginal edge, the first set of substrates having equally spaced parallel notches extending between the elements from the front marginal edge of the substrates and the second set of substrates having parallel evenly spaced notches extending between the elements from the rear marginal edge, the first and second set of substrates being assembled in respective parallel rows and columns with the notches of the first set mating with the notches of the second set to form a grid structure in which the front marginal edges lie in a plane, the output end of the elements of the first set of substrates are unrestrained with respect to each other and the elements of the second set of substrates are restrained with respect to each other, the radiator elements comprising dual slotlines elements etched in the metallized film having a narrow input end inboard of the substrate and relatively wide output end along the front marginal edge and tapered edges therebetween interconnecting the input end and the output end, a rectangular termination located at the input end and a stripline having a narrow portion crossing the narrow input end of the slotline forming a transition and a rectangular termination coupled to the stripline in mating relationship with the termination of the slotline; and positioner means engaging the front marginal edges of the substrates for aligning the metallized portions of the unrestrained element ends of the first set of substrates and forming said first and second sets of substrates into a uniform grid pattern of the metallized restrained and unrestrained element ends.

7. The array of claim 6 wherein the positioner means comprises conductive tabs in the form of metal tape located inside corners of the intersections of the first and second sets of substrates and interconnecting adjacent metallized surfaces thereof.

8. The array of claim 7 wherein the metallized portions include soldered joints.

9. The array of claim 6 wherein the positioner means comprises a planar member having spaced rows of slots in intersecting rows and columns corresponding to the respective restrained and unrestrained element ends and conductive tab means formed adjacent the slots at the intersection of the rows and columns corresponding to intersections of the restrained and unrestrained element ends for receiving and securing the metallized portions of the intersecting element ends therein.

10. The array of claim 6 wherein the bandwidth of the array is between 2 GHz and 18 GHz.

11. The array of claim 6 wherein the tapered edge is curved and has a center adjacent the input.

12. The array of claim 11 wherein the mating transitions are located at the input end and upstream of the center of the tapered edges.

13. The array of claim 6 wherein the positioner means is a dielectric.

14. The array of claim 6 further comprising a positioner, engageable with the unrestrained element ends.

* * * * *